US005793281A

United States Patent [19]

Long

[11] Patent Number: 5,793,281

[45] Date of Patent: Aug. 11, 1998

[54] METHOD AND APPARATUS FOR POINT OF SALE PROMOTIONAL ANNOUNCEMENTS

[75] Inventor: William E. Long, Seacliff, N.Y.

[73] Assignee: Besam Automated Entrance Systems, Inc., East Windsor, N.J.

[21] Appl. No.: 779,941

[22] Filed: Dec. 23, 1996

Related U.S. Application Data

[60] Provisional application No. 60/009,212 Dec. 26, 1995.

[51] Int. Cl.[6] ..... G08B 3/00

[52] U.S. Cl. ..... 340/384.1; 340/328; 340/545

[58] Field of Search ..... 340/328, 330, 340/384.1, 286.11, 545, 692, 573, 286.01

[56] References Cited

U.S. PATENT DOCUMENTS

| | | | |
|---|---|---|---|
| 2,991,448 | 7/1961 | Diamond et al. | 340/692 |
| 3,938,120 | 2/1976 | O'Connell . | |
| 4,100,581 | 7/1978 | Slack et al. | 340/692 |
| 4,400,786 | 8/1983 | Mandel et al. | 340/692 |
| 4,698,937 | 10/1987 | Korbrekke et al. | 340/545 |
| 4,833,454 | 5/1989 | Pawlik et al. | 340/384.6 |
| 4,882,724 | 11/1989 | Vela et al. | 364/401 |
| 4,912,457 | 3/1990 | Ladd | 340/573 |
| 4,984,098 | 1/1991 | Buntsis | 369/19 |
| 5,138,638 | 8/1992 | Frey | 340/545 |
| 5,264,822 | 11/1993 | Vogelman et al. | 340/286.01 |
| 5,295,064 | 3/1994 | Malec et al. | 340/825.35 |
| 5,365,214 | 11/1994 | Angott et al. | 340/328 |
| 5,485,139 | 1/1996 | Tarnovsky | 340/692 |

*Primary Examiner*—Brent A. Swarthout
*Attorney, Agent, or Firm*—Baker & Botts, LLP

[57] ABSTRACT

An automatic audio message delivery device is associated with the operation of an automatic door at a retail establishment. Data communications are provided to update promotional messages to be delivered and to enable the device to centrally report information on message delivery traffic and service requirements of the automatic door.

7 Claims, 3 Drawing Sheets

METHOD AND APPARATUS FOR POINT OF SALE PROMOTIONAL ANNOUNCEMENTS

This application is based on and claims the benefit of the filing date of co-pending Provisional application Ser. No. 60/009212, filed Dec. 26, 1995.

BACKGROUND OF THE INVENTION

The present invention relates to an apparatus for automatic delivery of promotion al messages and other messages, for use in connection with an automatic door system. Arrangements have been known for delivery of point-of-sale messages by audio devices, for example, in supermarkets, which are arranged to be initiated by the detected presence of a shopper, to deliver a particular message. As conventionally implemented such systems repetitively deliver the same message to each passerby, and because of such repetition can cause annoyance to the customer and store personnel, rendering the message ineffective. Further, frequent changing of the messages, in accordance with current sales promotional activities, can be inconvenient because of the need to manually change a message delivery device such as a programmed memory or an audio tape.

Modern automatic doors can include control systems which include functions for self-testing their various components to assure proper operation and to detect incipient failures. Such systems, however, are only capable of giving detailed service reports when inspected and read by service personnel.

It is an object of the present invention to provide a message delivery apparatus for use in conjunction with an automatic door, for selectively delivering messages and for automatically receiving and recording message changes. It is a further object to provide such a system having the capability of providing door operating information to service personnel and store traffic information to marketing personnel.

SUMMARY OF THE INVENTION

In accordance with the invention there is provided an apparatus for delivering messages in response to activation of automatic door sensors, for operation with an automatic door system having at least one sensor for providing signals responsive to door traffic. A message delivery device is provided having a message memory for storing digitally encoded voice messages and a programmed microcomputer for selecting messages in response to signals from the door sensor and an audio output device for announcing the selected message. The message delivery device includes a first communication device and instructions for causing the micro-computer to store data corresponding to digitally encoded voice messages, which is received by the communications device. The system includes at least one control computer having a second communications device for periodically sending data, corresponding to the digitally encoded voice messages, to the first communications device of the message delivery device.

The digital encoded voice messages can include a first group of messages which are selected in response to sensor signals corresponding to normal traffic patterns at the automatic door system, and second messages which are delivered in response to sensor signals corresponding to an abnormal traffic pattern. In one arrangement the automatic door system may include self-test apparatus which provides error signals, representing abnormal door system conditions, to the microcomputer of the message delivery device, so that the error signals can be sent by the communications device to a service computer, for example, when the control computer provides voice message data to the message delivery device. The system may also accumulate data corresponding to normal traffic through the automatic door system and provide such data to the central computer by the communications device.

In accordance with the invention there is provided a method for delivering commercial messages to customers at a retail establishment comprising selecting groups of first messages to be provided to a retail establishment as digital encoded voice data, sending groups of messages by a communications link to the retail establishment and storing the messages in a memory device associated with an automatic door at the establishment and providing an audio output of a selected one of the messages upon activation of the door.

For a better understanding of the present invention together with other and further objects, reference is made to the following description, taken in conjunction with the accompanying drawings, and its scope will be pointed out in the appended claims.

DESCRIPTION OF THE PREFERRED EMBODIMENT

Figure 1:
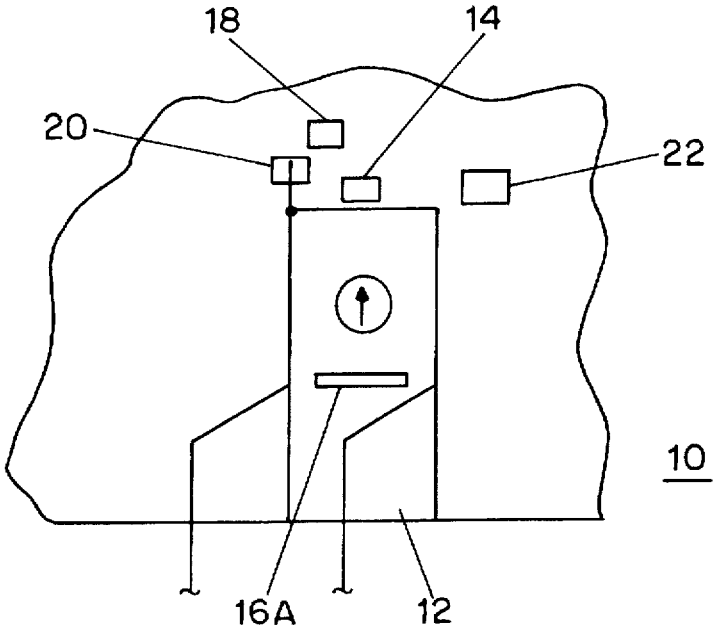
FIG. 1 is an illustration of an automatic door system having a message delivery device according to the present invention.

FIG. 1 is a simplified illustration of a door system having a message delivery device according to the present invention. The door system 10 includes a motor operated door 12 and associated sensors, such as microwave sensor 14 and door mounted safety sensor **16*a*, including a comparable safety sensor 16*b* mounted on the reverse side of door 12. Sensors 14, 16*a* an 16*b* are shown as examples in the FIG. 1 embodiment and in some cases may consists of other known traffic sensing devices such as floor mats or active or passive infrared sensing devices. Sensors 16*a* and 16*b* are active infrared sensing devices of the type described, for example, in U.S. Pat. No. 4,467,251 to Bert O. Jonsson. Sensors 14, 16*a* and 16*b* provides signals to a door controller 18 which controls the operation of motor 20 to open and close door 12. For example, the detection of approaching traffic by microwave sensor 14 will provide a signal to controller 18 which will activate motor 20 to open door 12 unless sensor 16*b* on the far side of door 12 detects the presence of an obstacle in the path of the door. Likewise, detection of an obstacle in the path of door closing by sensor 16*a* will cause controller 18 to operate motor 20 in a manner which maintains the door in the opened condition. In addition to these conventional components of an automatic door, the system of the present invention includes a message delivery device 22 for providing an audio message in response to signals received from sensors 14, 16*a* and 16*b* associated with the door system, or alternatively, signals from door controller 18**.

Figure 2:
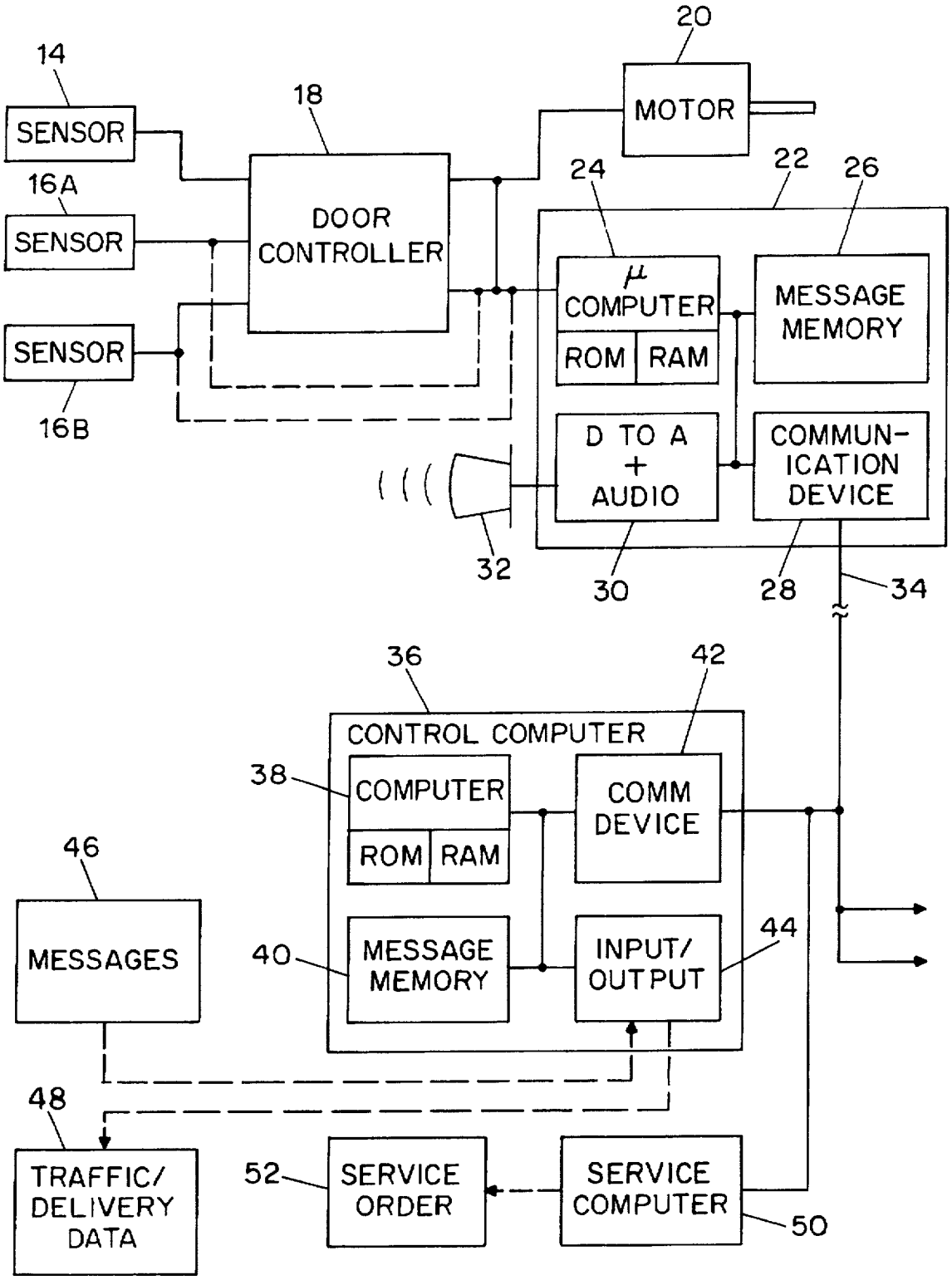
FIG. 2 is a block diagram of the embodiment of FIG. 1.

FIG. 2 is a block diagram showing the interconnection of message delivery device 22 with the automatic door system as shown in FIG. 1. Conventional sensors 14, 16*a* and 16*b* provide signals to door controller 18 which controls the operation of door motor 20 as described. Message delivery device 22 is connected to door controller 18, for example, to the motor activation output of door controller 18 to receive a signal indicating that the door is being opened in response to the approach of a customer. Message delivery device 22 includes a microcomputer 24 having associated read only memory for its program and random access memory for data. There is also provided a message memory 26 which has a large data capacity for storing digitally encoded voice messages, which may be in compressed digital form. Message delivery device 22 also includes a digital-to-analog converter and audio output device 30 which is connected to a loudspeaker 32 for delivering messages. There is also provided a communications device 28 for receiving digital messages for example over a telephone line 34.

The system of the invention includes a control computer 36 which is remotely located from the retail establishment having the automatic door system 10. Control computer 36 is arranged to receive messages and configure the messages into message groups for delivery over telephone lines to a plurality of message delivery devices 22. Control computer 36 includes conventional computer components 38 and a communications device 42 which is compatible with the communications device 28 in message delivery device 22. Control computer 36 also has a message memory 40 and an input/output device 44, which may include a disc reader for receiving data corresponding to encoded voice messages from a disc, and output devices for delivering information received by the control computer from the message delivery device 22.

Control computer 36 may also provide messages to a service computer 50 as will be further explained.

The system of the present invention is designed to provide utmost flexibility in connection with delivering of audio promotional messages at a retail or other establishment. By use of data communications from the control computer, messages can be tailored to individual establishment or groups of establishments on a geographic or other demographic basis, and can be changed on a daily or more frequent basis to conform with the marketing pattern of a particular retail establishment. For example, messages can be changed during the course of a business day to address demographic groups in the morning, afternoon and evening.

The invention contemplates that each of the message delivery devices 22 will be provided with a plurality, for example 20, of different commercial messages. Such messages will be played by the message data device in a pattern that causes a different message to be delivered on each subsequent activation of automatic door 10.

The messages provided to the message delivery device 22 can alternatively be general promotional messages, such as "Foodway has the best prices in town", or special promotions, such as "Our special today is filet mignon, only $1.99 per pound", or a national brand message such as "Buy some Sudso detergent for the cleanest wash in town". In accordance with the originator of the message, advertising or promotional charges can be levied, and such charges can be based on the actual number of message deliveries which can be reported and recorded by message delivery device 22.

The microcomputer 24 of message delivery device 22 has the ability to record in its random access memory the number of activations within a given time period and hence the number of messages delivered by message delivery device 22. This data can be provided to control computer 36 by communications device 28 on a daily or weekly basis, for example, at the time when new messages are delivered to update message memory 26. Such data communications can conventionally take place during late evening hours, when the establishment is normally closed or when customer traffic is low.

The principle advantage of the invention is that the messages can be tailored to each individual store. The messages chosen for delivery in a store can be varied by the control computer 36 according to demographics, including the geographic location of the store and even a particular neighborhood in which the store is established, for example promoting more expensive products in a wealthier area of town. Using data from the store's sales records as to purchasing patterns, it is possible to promote different items according to the preference of the local customers. Control computer 36 advantageously provides an output of traffic delivery data 48 which can be used to gage the effectiveness of announcements by correlating the output message delivery data 48 for a particular message with the sales records of a particular retail establishment. Thus, if a message promotes a particular product, such as Sudso, the sales data from a particular retail establishment for that product can be compared to the message delivery data to objectively evaluate message effectiveness. Likewise, different messages promoting the same product can be used in different stores of the same chain to evaluate the relative effectiveness of the messages prior to placing them in the entire chain.

It is to be understood that the invention is not intended to be limited to retail establishments, but can additionally apply to other facilities, such as railroad stations, hotels and the like.

Another function that can be provided by the message delivery device 22 of the present invention is to provide service information to the service company that maintains the automatic door. Because of the need for safety, proper maintenance of automatic doors and their sensors is an important consideration. The control unit 18 of an automatic door may include self-test equipment which monitors the status of sensors 14, 16*a* and 16*b* and, for example, the performance of door motor 20. Even before an equipment defect results in malfunctions, such self-test equipment can detect a need for service and an indication of the particular component that requires service. This service data from door controller 18 can be provided as an error signal to microcomputer 24 in message delivery device 22. Such an error signal can be communicated to control computer 24 along with the report of promotional message delivery information and reported by control computer 36 automatically to a service computer 50 which will generate service order 52, indicating the existence of an abnormal condition in the automatic door system and the nature of the abnormal condition, so that a service person can be dispatched to the establishment with the necessary tools, test equipment and parts to effect a repair.

Another function that can be performed by message delivery device 22 is to provide a special message in response to abnormal door traffic or a detected safety hazard. For example, if a person is standing in a position which prevents a door from closing and remains in that position for an undue period of time, message delivery device 22 can be activated to provide a second type of message which will request, for example, that the person move away from the door. Such activation can be activated in response to a long period of door open condition, as determined by a timer, or alternatively can be based on the output of safety sensors 16*a* and 16*b* which can be provided directly to microcomputer 24 as indicated by the dotted lines in FIG. 2.

Figure 3:
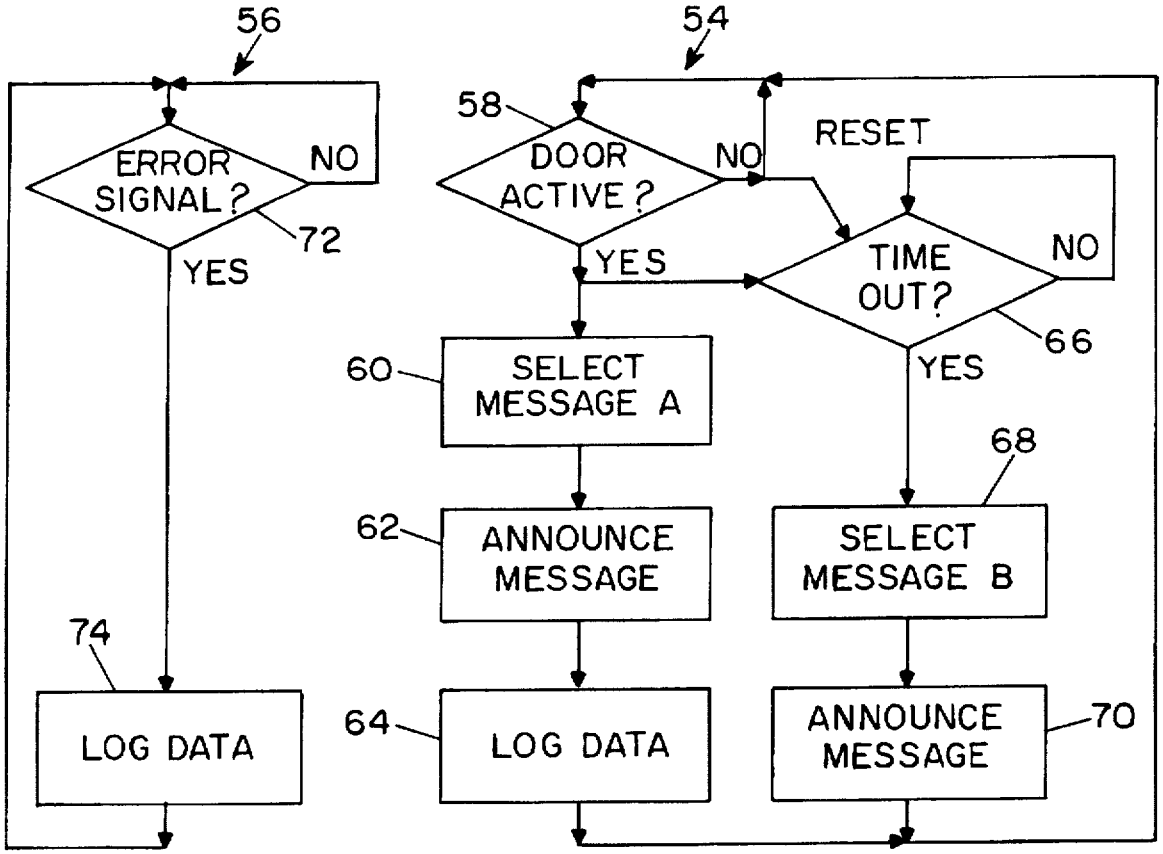
FIG. 3 is a program flow diagram for the microcomputer of the message delivery device according to FIG. 1.

FIG. 3 is an exemplary flow diagram for a microcomputer program for microcomputer 24 during normal door operation. In a first program loop 54, the microcomputer searches for an input indicating that the door has activated to open. It selects a message from a first message group comprising commercial messages and causes that message to be announced to the arriving customer. Microcomputer 24 thereafter makes a log entry in its random access memory to record the delivery of the message and normally awaits the next door activation. The door activity sensor is also provided to a time-out circuit 66 which will activate a second message delivery from a second set of messages at operation 68 and 70, for example, to request that a person move away from the door.

An additional loop 50 can be interposed on loop 54 to periodically detect the existence of a error signal from door control 18 indicating a malfunction or incipient malfunction of the door system and to log the error signal if it occurs.

Figure 4:
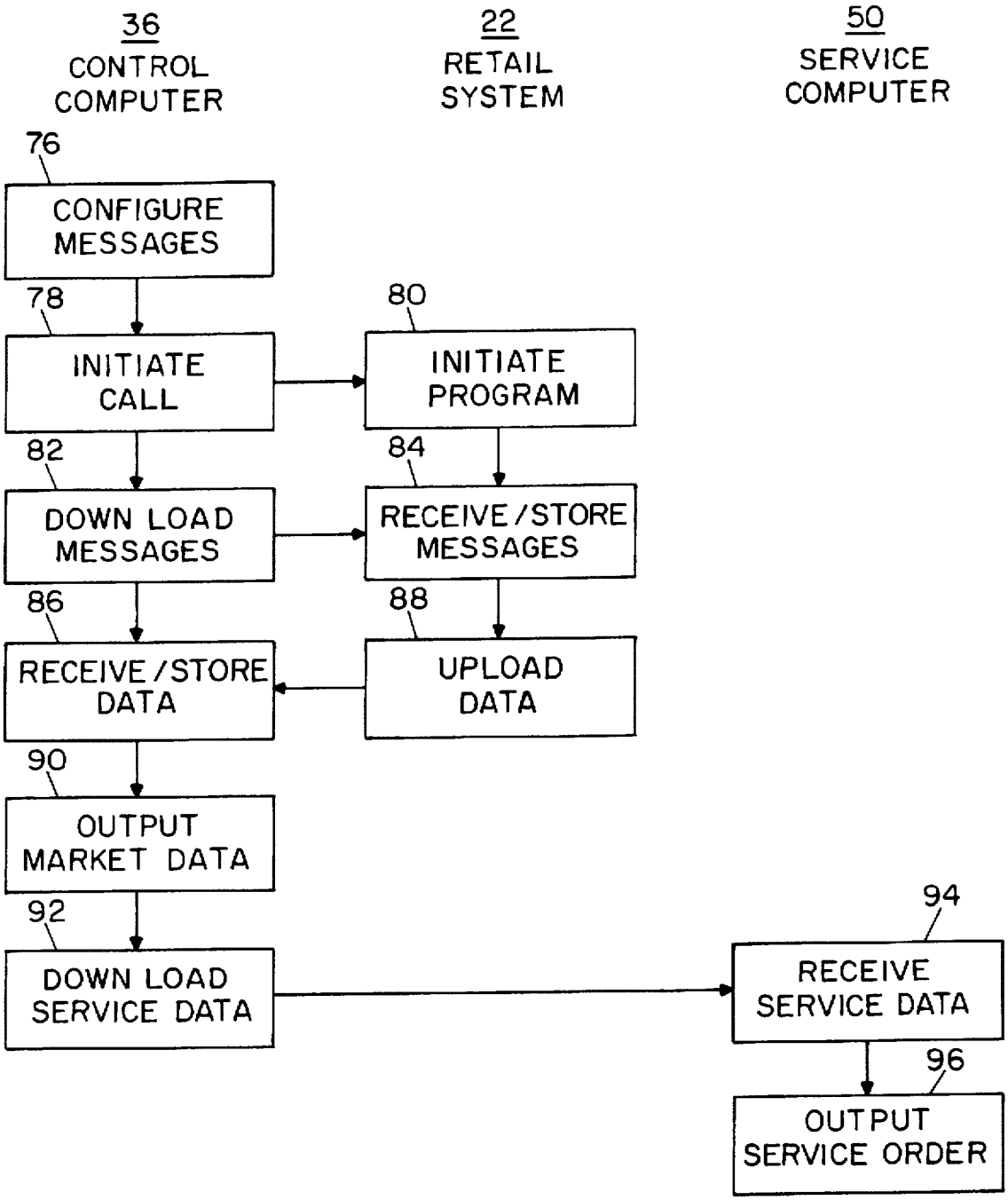
FIG. 4 is an outline of tasks associated with the system illustrated in FIG. 2.

FIG. 4 shows a sequence of communications between the message delivery device 22 at a retail establishment, a control computer 36 and possibly a service computer 50. Messages are configured by a control computer according to the desired advertising parameters which might be determined by the advertising agency or company management. Periodically, for example each night, the control computer 36 initiates a call at step 78 to one or more message devices 22 at retail establishments which are to receive the same group of promotional messages. At step 80 the microcomputer 24 at the retail establishment, upon receiving the telephone communication from control computer 36, interrupts the normal message delivery routine of FIG. 3 and initiates a program to receive and store new promotional messages in message memory 36. At step 82 the control computer downloads the digitally encoded voice messages to the delivery devices 22 and the messages are received and stored at step 84. Following this process the delivery devices 22 have the opportunity at step 88 to upload data, which is received by the central computer at 86. Alternatively the data upload step can be separately initiated by each retail system, or can be performed during a single communication, for example, by having the central computer poll each of the delivery devices 22 to which connection has been established. The central computer then has the opportunity to provide an output of the message delivery traffic data 48 it has received at step 90 in a form that can be used for analysis by advertising and marketing personnel, particularly for judging effectiveness of the messages. Also at step 92 the control computer 36 can initiate and deliver a message comprising service data to the appropriate service computer 50 of the door service provider corresponding to a particular retail establishment. The service data can thereby generate a service order 52 indicating the retail establishment and the type of service apparently required. In the event the service provider does not have a compatible computer system, the central computer can initiate a facsimile or other message to the service provider.

In some instances the service provider may determine that the condition indicated by the service data message can be corrected by a software or data correction in the door controller 18. In this instance a message with the required software or data correction can be provided to the message delivery device 22 with instructions to microcomputer 24 to relay the corrected software or data for storage and use by door controller 18. In this manner certain adjustments to the door operation can be effected without a service call.

While there has been described what is believed to be the preferred embodiment of the present invention, those skilled in the art will recognize that other and further modifications may be made thereto without departing from the spirit of the invention, and it is intended to claim all such changes as fall within the true scope of the invention.

I claim:

1. Apparatus for providing messages in response to activation of automatic door sensors, comprising:

an automatic door system having at least one sensor for providing signals responsive to door traffic;

a message delivery device comprising a message memory for storing digitally encoded voice messages, including first messages and second messages, a programmed microcomputer for selecting one of said first messages in response to said sensor signals corresponding to normal traffic patterns and for selecting one of said second messages in response to sensor signals corresponding to abnormal traffic patterns and an audio output device for announcing the selected message, said message delivery device including a first communications device for telephone data communications, said microcomputer including instructions for storing data corresponding to said digitally encoded voice messages received by said communications device; and at least one control computer having a second communications device for periodically sending said data corresponding to said digitally encoded voice message to said first communications device of said message delivery device.

2. A system as specified in claim 1 wherein said microcomputer is further programmed to accumulate traffic data corresponding to the number of said sensor signals received, and to periodically provide said traffic data to said control computer by said first communications device.

3. A method for delivering commercial messages to customers at a retail establishment comprising:

at a control location selecting groups of first messages to be provided to said retail establishment, said messages comprising digitally encoded voice data;

sending said groups of first messages by communications link to said retail establishment and storing said messages in a memory device, associated with an automatic door at said retail establishment;

storing second digitally encoded voice messages in said memory device;

and providing an audio output of a selected one of said first messages in said group of messages upon normal activation of said automatic door and providing an audio output of one of said second messages in response to an abnormal condition of said door.

4. The method as specified in claim 3, further comprising storing at said retail establishment traffic data representing the number of times said audio output has been provided and communicating said traffic data to said control location.

5. Apparatus for providing messages in response to activation of automatic door sensors, comprising:

an automatic door system having at least one sensor for providing signals responsive to door traffic, said automatic door system including self-test apparatus for providing error signals representing abnormal door operating conditions;

a message delivery device comprising a message memory for storing digitally encoded voice messages, a programmed microcomputer for selecting messages in response to said sensor signals and an audio output device for announcing the selected message, said message delivery device including a first communications device for telephone data communications, said microcomputer including instructions for storing data corresponding to said digitally encoded voice messages received by said communications device and including instructions for receiving said error signals and for causing said error signals to be sent to a service computer by said first communications device; and at least one control computer having a second communications device for periodically sending said data corresponding to said digitally encoded voice message to said first communications device of said message delivery device.

6. A system as specified in claim 5 wherein said microcomputer provides said error signals to said control computer when said control computer sends said data corresponding to said digitally encoded voice messages.

7. A method for delivering commercial messages to customers at a retail establishment comprising:

at a control location selecting groups of first messages to be provided to said retail establishment, said messages comprising digitally encoded voice data;

sending said groups of first messages by a communications link to said retail establishment and storing said messages in a memory device, associated with an automatic door at said retail establishment;

providing an audio output of a selected one of said first messages in said group of messages upon activation of said automatic door;

storing error data at said retail establishment representing abnormal operating conditions of said automatic door; and communicating said error data to a central location by said communications link.

* * * * *